US007614863B2

(12) United States Patent
Sommer

(10) Patent No.: US 7,614,863 B2
(45) Date of Patent: Nov. 10, 2009

(54) ROTARY PUMP PROVIDED WITH AN AXIALLY MOVABLE BLADE

(76) Inventor: Manfred Sommer, Forststrasse 30-32, 74199 Untergruppenbach-Vorhof (DE)

( * ) Notice: Subject to any disclaimer, the term of this patent is extended or adjusted under 35 U.S.C. 154(b) by 168 days.

(21) Appl. No.: 10/597,044

(22) PCT Filed: Dec. 21, 2004

(86) PCT No.: PCT/DE2004/002788

§ 371 (c)(1),
(2), (4) Date: Jul. 10, 2006

(87) PCT Pub. No.: WO2005/066496

PCT Pub. Date: Jul. 21, 2005

(65) Prior Publication Data

US 2007/0148027 A1 Jun. 28, 2007

(30) Foreign Application Priority Data

| | | |
|---|---|---|
| Jan. 9, 2004 | (DE) | 20 2004 000 183 U |
| Jan. 9, 2004 | (DE) | 20 2004 000 184 U |
| Jan. 9, 2004 | (DE) | 20 2004 000 185 U |
| Jan. 9, 2004 | (DE) | 20 2004 000 186 U |
| Jan. 9, 2004 | (DE) | 20 2004 000 188 U |
| Jan. 9, 2004 | (DE) | 20 2004 000 189 U |

(51) Int. Cl.
*F01C 1/00* (2006.01)

(52) U.S. Cl. ..... 418/217; 418/218; 418/219

(58) Field of Classification Search ..... None
See application file for complete search history.

(56) References Cited

U.S. PATENT DOCUMENTS 2,583,704 A * 1/1952 Nicholls et al. ..... 60/485
3,133,506 A 5/1964 Luciani
3,994,638 A * 11/1976 Garland et al. ..... 418/216
4,492,541 A * 1/1985 Mallen-Herrero et al. ..... 418/23

(Continued)

FOREIGN PATENT DOCUMENTS

DE 34 18 708 A1 11/1984

(Continued)

OTHER PUBLICATIONS

International Search Report for International Application No. PCT/DE2004/002788, date of mailing Oct. 5, 2005.

(Continued)

*Primary Examiner*—Thomas E Denion
*Assistant Examiner*—Douglas J Duff
(74) *Attorney, Agent, or Firm*—Darby & Darby P.C.

(57) ABSTRACT

A pump (10) possesses a rotor (70), the rotor collar (120) of which laterally delimits a pumping duct (124) with an inlet (152) and an outlet. An axially adjustable sealing slide (182) bears sealingly against the rotor collar (120) on both sides in the axial direction and subdivides the pumping duct (124) between the inlet (152) and the outlet. A first bearing point for the drive shaft (60), for the supporting mounting of the drive shaft in the radial direction, is present within the clear space region occupied in the axial direction by the rotor (70).

19 Claims, 4 Drawing Sheets

U.S. PATENT DOCUMENTS 4,575,324 A * 3/1986 Sommer et al. ..... 418/217
5,352,103 A * 10/1994 Auer ..... 418/101
5,505,595 A * 4/1996 Fukui ..... 418/55.1
5,678,986 A * 10/1997 Terauchi et al. ..... 418/55.6
5,980,225 A * 11/1999 Sommer ..... 418/104
6,773,244 B2 * 8/2004 Lee et al. ..... 418/216
6,881,041 B2 * 4/2005 Lee ..... 417/356
6,893,242 B2 * 5/2005 Yang et al. ..... 418/216
2004/0033150 A1 * 2/2004 Lee et al. ..... 418/92

FOREIGN PATENT DOCUMENTS

DE 195 22 560 A1 1/1997

OTHER PUBLICATIONS

Maso Process-Pumpen; Sundyne Corporation: "Manual-Technical Documentation Maso-Sine-Pump MR 160", Announcement Sundyne. Jan. 2003. XP-001219572.

* cited by examiner

ROTARY PUMP PROVIDED WITH AN AXIALLY MOVABLE BLADE

CROSS REFERENCE TO PRIOR APPLICATION

This is a U.S. national phase application under 35 U.S.C. §371 of International Patent Application No. PCT/DE2004/002788 filed Dec. 21, 2004, and claims benefit of German Patent Application No. 20 2004 000 183.7 filed Jan. 9, 2004, German Patent Application No. 20 2004 000 184.5 filed Jan. 9, 2004, German Patent Application No. 20 2004 000 185.3 filed Jan. 9, 2004, German Patent Application No. 20 2004 000 186.1 filed Jan. 9, 2004, German Patent Application No. 20 2004 000 188.8 filed Jan. 9, 2004, and German Patent Application No. 20 2004 000 189.6 filed Jan. 9, 2004 which is incorporated by reference herein. The International Application was published in German on Jul. 21, 2005 as WO 2005/066496 A1 under PCT Article 21(2).

TECHNICAL FIELD

The invention relates to a pump designed as a positive displacement pump or rotary piston pump. The main areas of use of such pumps conveying thick-flowing and viscous products are found in the chemical, pharmaceutical and food-processing industry.

PRIOR ART

A pump of the type initially mentioned is known from DE 34 18 708 A1. This pump possesses a rotor which is mounted fixedly in terms of rotation on a drive shaft connectable to a motor drive. The rotor possesses a radially projecting rotor collar running around in a wavy manner. The inlet and outlet of the pump are separated from one another. The inlet communicates with a suction-intake space and the outlet communicates with an outlet space. These two pump spaces are connected to one another by a pumping duct. An axially adjustable sealing slide bearing sealingly against the rotor collar on both sides in the axial direction ensures that the medium conveyed in each case through the pumping duct from the inlet to the outlet cannot flow past the sealing slide backward to the inlet again. During the rotational movement of the rotor, therefore, the sealing slide must continuously bear sealingly against the rotor collar on both sides. Sufficient sealing must also be present between the rotor collar and the walls of the pumping duct which axially delimit the rotor collar if the conveying action and consequently the efficiency of the pump are not to be impaired. In this pump, the drive shaft driving the rotor projects far into the pump space. Its bearing points are located, on the one hand, in the region of the rear casing wall and, on the other hand, outside the pump casing, in a hollow-cylindrical shaft carrier flanged to the rear wall of the pump casing. The rotor consequently sits on the projecting end region of the drive shaft. On account of the unavoidable flexions of the projecting end region of the drive shaft, which are the greater, the higher are the working pressures with which the pump is operated, correspondingly large tolerances between the rotating parts, such as the rotor collar, and the nonrotating parts, such as the duct walls laterally framing the pumping duct, have to be taken into account in order to avoid an undesirably high wear of parts rubbing against one another.

PRESENTATION OF THE INVENTION

Proceeding from this known prior art, the object on which the invention is based is to specify a pump of the type initially mentioned, which, in particular, can be operated, even at high working pressures, in an economically beneficial way.

This invention is afforded by the features of the main claim. Expedient developments of the invention are the subject matter of further claims following the main claim.

The pump according to the invention is distinguished in that a bearing point for the drive shaft is present within the clear space region occupied in the axial direction by the rotor. The drive shaft therefore no longer projects freely into the pump space, but, instead, is mounted, supported in the radial direction, within the clear space region occupied in the axial direction by the rotor or else, preferably, in the clear space region occupied in the axial direction by the rotor collar. The extremely high flexions which, in the case of correspondingly high working pressures, have to be taken into account in structural terms in the prior art then no longer occur. This means that the bearing designs of the drive shaft and the design of the drive shaft itself no longer have to be so highly dimensioned that the flexions in the projecting end region of the drive shaft become correspondingly low. The bearing point, present within the pump casing, for the drive shaft has the further advantage that the overall length of the pump becomes substantially shorter, as compared with the known pump; to be precise, the hollow-cylindrical shaft carrier according to the known prior art, which is flanged on from outside and at whose end further away from the pump casing a further bearing point for the drive shaft is formed, can then be dispensed with. A sufficient mounting of the drive shaft can be provided in the region of the rear wall of the pump and within the clear space profile occupied in the axial direction by the rotor or its rotor collar.

According to the exemplary embodiments, also illustrated in the drawing, the bearing point, present within the pump casing, for the drive shaft can be implemented by a hollow-cylindrical shaft carrier which projects freely from the rear region of the pump into the interior of the latter. The shaft carrier can have a sufficiently flexion-resistant design, so that the unavoidable flexions at its projecting end are unimportant for the practical operation of the pump. For the rotor arranged fixedly in terms of rotation on the projecting end region of the shaft carrier and for the rotor collar of the rotor, therefore, a bearing which is virtually fixed in the axial direction can be adopted in structural terms. Such a pump not only has a substantially shorter build than the pump known above in the prior art, but can also be operated with comparatively higher working pressures.

As already mentioned, the rotor collar must bear as sealingly as possible against the fixed wall regions axially delimiting the pumping duct, in order to make it possible for the pump to have correspondingly high efficiency. In order, then, to prevent a wear of the casing walls and of the rotor due to mutual friction, it is known to line the pumping duct with exchangeable wearing parts, that are known as stators. Existing flexions of the drive shaft, such as are present in the prior art, make it necessary to maintain between the rotor and the stator tolerances which must be such that the rotor does not touch the stator under the maximum load of the pump. This is remedied, to some extent, in that plastic is used for the stator, so that, when it is touched by the rotor produced from steel, there is no removal of material caused by steel on steel. This problem is the more serious, the greater the flexion of the drive shaft is. Where these tolerances to be maintained are concerned, it must also be taken into account, in this respect, that the various plastics expand to a different extent under the action of heat. To be precise, the cleaning of such pumps takes place, as a rule, at temperatures which lie at 100 degrees Celsius and above, so that corresponding expansion tolerances of the respective plastics have to be taken into account in the design of the pump, so that it continues to be ensured that the rotors can rotate freely in the pump space even at high temperature. The problem of the tolerances to be maintained is also influenced most decisively by the existing flexions of the drive shaft and consequently of the rotor seated on it; if the tolerances are too high, the efficiency of the pump falls steeply.

With the pump according to the invention, it is therefore no longer necessary to resort to higher-power pumps in order to avoid the above problem; higher-power pumps not operated at full power have correspondingly lower flexions, and therefore the tolerance problem is more favorable. Such larger pumps, which would not be required per se in operational terms, increase the operating costs of such a pump.

Since the drive shaft forms, together with the shaft carrier, a freely projecting structural part, the rotor can surround the drive shaft and in this case also the shaft carrier on the end face in the manner of an end cap. This then allows simple mounting and demounting of the rotor, in that the rotor can be pushed fixedly in terms of rotation onto the drive shaft axially and be held immovably on the drive shaft axially, for example by means of a holding or closing nut.

The bearing point of the drive shaft may be formed on the inside of the shaft carrier. An additional bearing point for the rotor may be formed on the opposite outside of the shaft carrier, insofar as the cap wall of the rotor is not so flexion-resistant that the rotationally fixed bearing point of the rotor on the drive shaft is sufficient.

According to an exemplary embodiment illustrated in the drawing, it is also possible to arrange the bearing point for the drive shaft on the outside of the shaft carrier. This bearing point can then be used at the same time as an axially acting bearing point for the rotor or for the cap region of the latter. In this case, the drive shaft is attached to the shaft carrier from outside via the rotor.

The respective bearing point, present in the projecting end region of the shaft carrier, for the drive shaft and for the rotor, insofar as said bearing point is provided in addition to the rotationally fixed mounting of the rotor, may be arranged in the same axial cross-sectional plane.

In order to form bearings which are as slender as possible, each bearing point may consist of a plurality of bearings lying next to one another in the axial direction.

In addition to this first bearing point described above, which is present within the pump casing, a second bearing point for the drive shaft may be present in the region of the pump rear wall adjacent to the motor drive. Where very light pump designs are concerned, this second bearing point could even be dispensed with and the drive shaft be mounted only in the region of the motor drive.

It proved advantageous to fasten the pump casing to a bearing block in such a way that the pump casing can be fastened to the latter in various rotary positions. In this way, the inlet and outlet can be optimally adapted in spatial terms to the corresponding local conditions, even in the case of the circular-cylindrical outer contour of the pump casing. Such a bearing block may possess a holding flange, to which the pump casing can be screwed, for example, in the rotary position desired in each case. The drive shaft then penetrates through this holding flange and terminates in the pump casing.

The already abovementioned second bearing point, alternatively present, for the drive shaft may then be provided in the holding flange.

Alternatively to this, this second bearing point could also be provided in the rear wall of the pump casing.

The shaft carrier projecting freely into the pump casing may be fastened to the rear wall of the pump casing or else to the holding flange in a flexion-resistant manner. The shaft carrier, which in this case is not a weighty component of the pump casing, does not have to be taken into account in terms of weight when the pump casing is being removed from the holding flange.

In order to prevent the situation where, after the opening of the pump and after the rotor has been drawn off axially from its bearings, such as, for example, the radial bearings described above, the bearing oil of these bearings runs out and soils the interior of the pump, these bearings may be covered with a bush. When the rotor is being demounted, such a bush remains as a mounted-on structural part on the bearing or bearings and seals off these, unchanged, in a reliable way. The mounting and demounting of the sleeve may be facilitated by means of ventilation grooves integrally formed in the sleeve wall or by ventilation bores passing axially through the sleeve wall.

Further advantages and features of the invention may be gathered from the features specified furthermore in the claims and from the following exemplary embodiments.

BRIEF DESCRIPTION OF THE DRAWING

The invention is described and explained in more detail below with reference to the exemplary embodiments illustrated in the drawing in which.

WAYS OF IMPLEMENTING THE INVENTION

Figure 1:
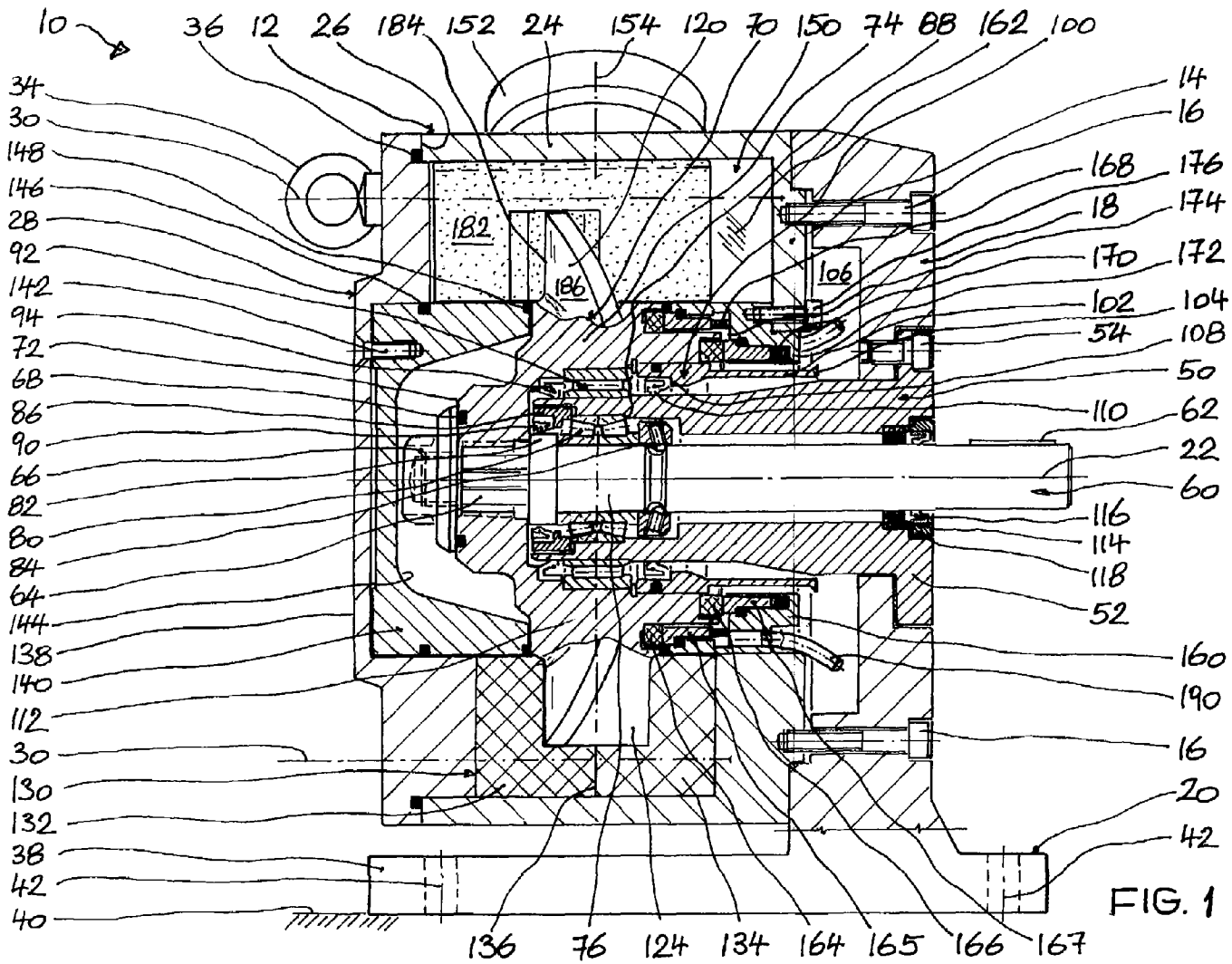
FIG. 1 shows a vertical longitudinal section through a first embodiment of a pump according to the invention.

The pump 10 illustrated in FIG. 1 is screwed with the rear wall 14 of its casing 12 to the holding flange 18 of a bearing block 20 by means of screws 16. The casing 12 is designed so as to be rotationally symmetrical about its axis 22, with the rear wall 14, circular in horizontal projection, and with a circle-cylindrical jacket wall 24 connected in one piece to the rear wall 14.

A cover 28 closing the casing 12 in the axial direction bears against that end wall 26 of the jacket wall 24 which is on the left in FIG. 1. The cover 28 is screwed to the rear wall 14 via a plurality of studs which are arranged so as to be distributed circumferentially on the cover 28 and of which FIG. 1 illustrates only two with their stud axis 30. The studs lead through the interior of the casing 12. Of the studs, the respective ring nut 34 screwed on on the outside is illustrated in FIG. 1. An O-ring 36, which ensures the required leaktightness, is inserted between the end face 26 of the jacket wall 24 and the cover 28 in an annular groove running around in the cover 28.

The inner wall of the jacket wall 24 may be designed circle-cyclindrically or, for the purpose of easier shaping in the production of the integral piece consisting of the rear wall 14 and of the jacket wall 24, slightly conically.

The thread sections present at the two ends of the stud are smaller in diameter than the diameter of the stud shank present in the interior of the casing 12, so that each stud screwing the cover 28 and the rear wall 14 to one another holds the cover 28 and the rear wall 14 against one another at a defined mutual distance.

The bearing block 20 possesses a foot plate 38 which, in the present example, is connected at right angles to it and by means of which the casing 12 and consequently the pump 10 can be set up on a base 40. This base 40 may also be a structural part which may be oriented in space, as desired, since the foot plate 38 and consequently the entire bearing block 20 can be fastened releasably to said base 40 by means of a screw connection, of which two screw connection axes 42 are illustrated.

A hollow-cylindrical shaft carrier 50, the cylinder axis of which coincides with the axis 22, projects through the rear wall 14 into the interior of the casing 12. The shaft carrier 50 is fastened to the holding flange 18 by means of an end-face flange 52 by a plurality of circumferentially distributed screws 54 accessible from outside. The shaft carrier 50 is designed in terms of material and of cross section such that its projecting end region terminating in the casing 12 has, under load, virtually no flexion, or at least flexion which is negligible for the operation of the pump 10.

A drive shaft 60 projects centrally through the shaft carrier 50. That end of the drive shaft 60 which is on the right in FIG. 1 can be connected fixedly in terms of rotation by means of a feather key 62 to the output shaft, not illustrated in the drawing, of a motor drive, so that the drive shaft 60 can be driven in both directions of rotation.

A rotor 70 is fastened fixedly in terms of rotation to the projecting end 64 of the drive shaft 60, said projecting end terminating in the interior of the casing 12. With regard to FIG. 1, the rotor 70 is pushed from the left onto the projecting end 64 of the drive shaft 60 and is held, fixed in its plugged-on rotationally fixed position by means of a closing nut 66 screwed on the drive shaft 60 on the end face. The closing nut 66 bears, sealed off by an O-ring 68, against the end wall 72 of the rotor 70.

The rotor 70 possesses a rotor hub 74 which has a central recess pointing toward a rear wall 14, so that the rotor hub 74, in the form of a cap, surrounds the projecting end region 76 of the drive shaft 60 from outside at a distance. The projecting end region 76 is followed, in the direction of the projecting end of the drive shaft 60, by the projecting end 64 which is followed by the screwing region for the closing nut 66.

A tapered roller bearing 80 or angular roller bearing is formed in the projecting end region 76 between the drive shaft 60 and the shaft carrier 50. This tapered roller bearing 80 can absorb, in particular, radial and, furthermore, also axial forces. Such forces acting on the rotor 70 can be transmitted or removed to the shaft carrier 50 and ultimately to the bearing block 20 via the rotor hub 74 and via the drive shaft 60. The tapered roller bearing 80 consequently forms, for the drive shaft 60, a bearing point which is present in the interior of the casing 12, since the tapered roller bearing 80, by virtue of its support from the shaft carrier 50, is arranged so as to be virtually fixed in position in the casing 12. The drive shaft 60 is consequently held, supported in the region of the tapered roller bearing 80.

The tapered roller bearing 80 is held, on the side on the left in FIG. 1, by a shoulder widening 82 of the drive shaft 60 and, on the opposite right side, by an axially supported bearing inner ring 84 seated in a shaft groove. Radially on the outside, the tapered roller bearing 80 is held, fixed in position, between a supporting ring 86 screwed onto the shaft carrier 50 on the end face and a setback 88 integrally formed in the shaft carrier 50.

For sealing-off purposes, the shaft sealing ring 90, which bears sealingly against the shoulder widening 82, is arranged on the outside of the supporting ring 86.

On the outside of the shaft carrier 50 lying opposite the tapered roller bearing 80, a radial needle bearing 92 is arranged between the shaft carrier 50 and the rotor hub 74. The rotor hub 74 is supported on the shaft carrier 50 via this needle bearing 92. This bearing 92 is sealed off on its left side, with regard to FIG. 1, by means of a shaft sealing ring 94 which is present between the rotor hub 74 and the shaft carrier 50. On its opposite side, on the right with regard to FIG. 1, the radial needle bearing 92 is followed by a sealing ring receptacle 100.

This sealing ring receptacle 100 bears fixedly in terms of rotation against the inside of the rotor hub 74. The sealing ring receptacle 100, having a rotationally symmetrical cross section, projects by way of its wall end region 102 through the rear wall 14. A sharp edge 104 pointing away from the wall end region 102 ensures, in the event of a leakage, that the medium emerging in this case emerges from the shaft carrier 50 so as to be directed away from the region of the sealing ring receptacle 100. This leakage medium enters an interspace 106 which is formed between the rear wall 14 and the holding flange 18 and from which it can pass outward via orifices, not illustrated in the drawing, formed in the holding flange 18.

On a radially reentrant shoulder 108 of the sealing ring receptacle 100, a shaft sealing ring 110 is supported, which bears sealingly against the outside of the shaft carrier 50. Together with the shaft sealing ring 94, the shaft sealing ring 110 seals off the radial needle bearing 92 on both sides in the axial direction.

In the region of the holding flange 18, a further bearing in the form of a ball bearing 114 is present between the drive shaft 60 and the shaft carrier 50. This ball bearing 114 is sealed off relative to the outside of the holding flange 18 via a shaft sealing ring 116 which is itself held via a screwing ring 118 screwed from outside onto the holding flange 18.

In the configuration illustrated in FIG. 1, the tapered roller bearings 80 and the radial needle bearing 92 are arranged in the same cross-sectional plane 112.

This cross-sectional plane 112 lies within the axial region of the rotor hub 74 and, furthermore, also in the axial cross-sectional region of the rotor collar 120 formed in one piece on the rotor hub 74.

This rotor collar 120 possesses a continuous wavy configuration, as described in detail in DE 34 18 708 A1 already mentioned above with regard to the prior art.

In the lower region of the casing 12, a pumping duct 124 is present, within which the rotor collar 120 moves back and forth in the axial direction during the rotation of the drive shaft 60. The pumping duct 124 is formed, framed by a stator 130 which is composed of two stator halves 132, 134. In the present example, the two stator halves 132, 134 are designed with an identical cross section and bear sealingly one against the other via a common contact face 136. The two stator halves 132, 134 are held, pressed in between the cover 28 and the rear wall 14. The studs, already mentioned above, which hold the cover 28, fixed in position at a distance, against the rear wall 14, also pass through the stator 130 or through its two stator halves 132, 134, outside the pumping duct 124.

The cover 28 possesses a central cover region 138 projecting annularly outward. A rotationally symmetrical front bush 140 is partially seated in the inner concavity thereby formed. This front bush 140 is held, screwed to the cover 28 or to its central cover region 138, via screws 142 accessible from outside. The front bush 140 encases, at a distance, the end face of the rotor hub 74 and the closing nut 66 screwed on the drive shaft 60. Its inner wall 144, in the present case, is designed to be curved, without sharp edges, so that it can easily be cleaned. Via O-rings 146, 148 fitted continuously in the front bush 140, the front bush 140 is sealed off with respect to the cover 28 or to the rotor hub 74 and the left stator half 132.

The top side of the front bush 140, with regard to FIG. 1, forms the bottom of the suction-intake space or of the outlet space 150, via which the pumping duct 124 is in each case connected, on the one hand, to the inlet 152 and, on the other hand, to the outlet of the pumps 10. In the present example, the longitudinal axes 154 of the inlet 152 and of the outlet are at right angles to one another.

A holding ring 160 is positioned with its top side in alignment with the top side of the front bush 140 on that side of the rotor hub 74 which is on the right with regard to FIG. 1. This holding ring 160 forms with its top side, in the same way as the front bush 140, the bottom of the suction-intake space or of the outlet space 150.

The holding ring 160 constitutes the sealing bottom region of the suction-intake space or of the outlet space 150 between the rotor hub 74 and the rear wall 14 of the casing 12. In the present example, two sliding rings 164, 166 offset axially and radially with respect to one another and corotating with the rotor hub 74 are fitted in between the rotor hub 74 and the holding ring 160. Stationary sliding rings 165 and 167 bear with pressure against these sliding rings 164, 166. These latter sliding rings 165, 167 are pressed against the sliding ring 164 or 166 by spring rings 168 and 170 which are supported on the rear side on radially reentrant shoulders 172 and 174 of the holding ring 160.

The holding ring 160 is fastened to the rear wall 14 via screws 176 arranged so as to be distributed circumferentially.

The sliding rings 165, 167 may consist of any suitable material, such as, for example, in particular, even of ceramic material. The corotating sliding rings 164, 166 may consist, in particular, of metallic material.

The seals formed from the two sliding rings 164, 165 or 166, 167 may both be arranged in any desired mutual orientation in the axial direction.

The suction-intake space and the outlet space 150 are separated from one another in terms of pressure by means of a slide guide 162 which forms a leaktight shut-off plate between these two spaces. A sealing slide 182 bears, moveably back and forth in the axial direction, against the slide guide 162. The sealing slide 182 is arranged in the outlet space 150, so that, during its movement back and forth, it bears sealingly against the slide guide 162 as a result of the pressure prevailing in said outlet space and which is higher than the pressure prevailing in the suction-intake space. A downwardly open central perforation 184 for the rotor collar 120 is present in the sealing slide 182. The rotor collar 120, during its rotating movement, bears sealingly with its two axially lateral collar walls, of which one side wall 186 can be seen in FIG. 1. This design principle is likewise described in detail in DE 34 18 708 A1 already mentioned above.

The sealing slide 182 is held, on its side opposite the slide guide 162, by structural parts, not illustrated in the drawing, which are fixedly connected to the casing 12, so that the sealing slide 182 maintains its leaktight position against the slide guide 162, even in other rotary positions which are turned upside down with respect to the illustration in FIG. 1 and in which it is screwed to the holding flange 18, and does not fall away from the slide guide 162, for example, in the circumferential direction. The slide guide 162 can be fixed in position between the cover 28 and the rear wall 14, for example, by means of one of the studs illustrated by their axis 30.

A plurality of leakage outflows 190 project, distributed circumferentially, out of the rear wall 14 into the interspace 106. These tubular or pipe-shaped leakage outflows 190 connect the individual bearing spaces to one another via longitudinal and transverse bores, not illustrated in the drawing, which are formed in the shaft carrier 50, so that said leakage outflows can be used for lubricating these bearings.

Figure 2:
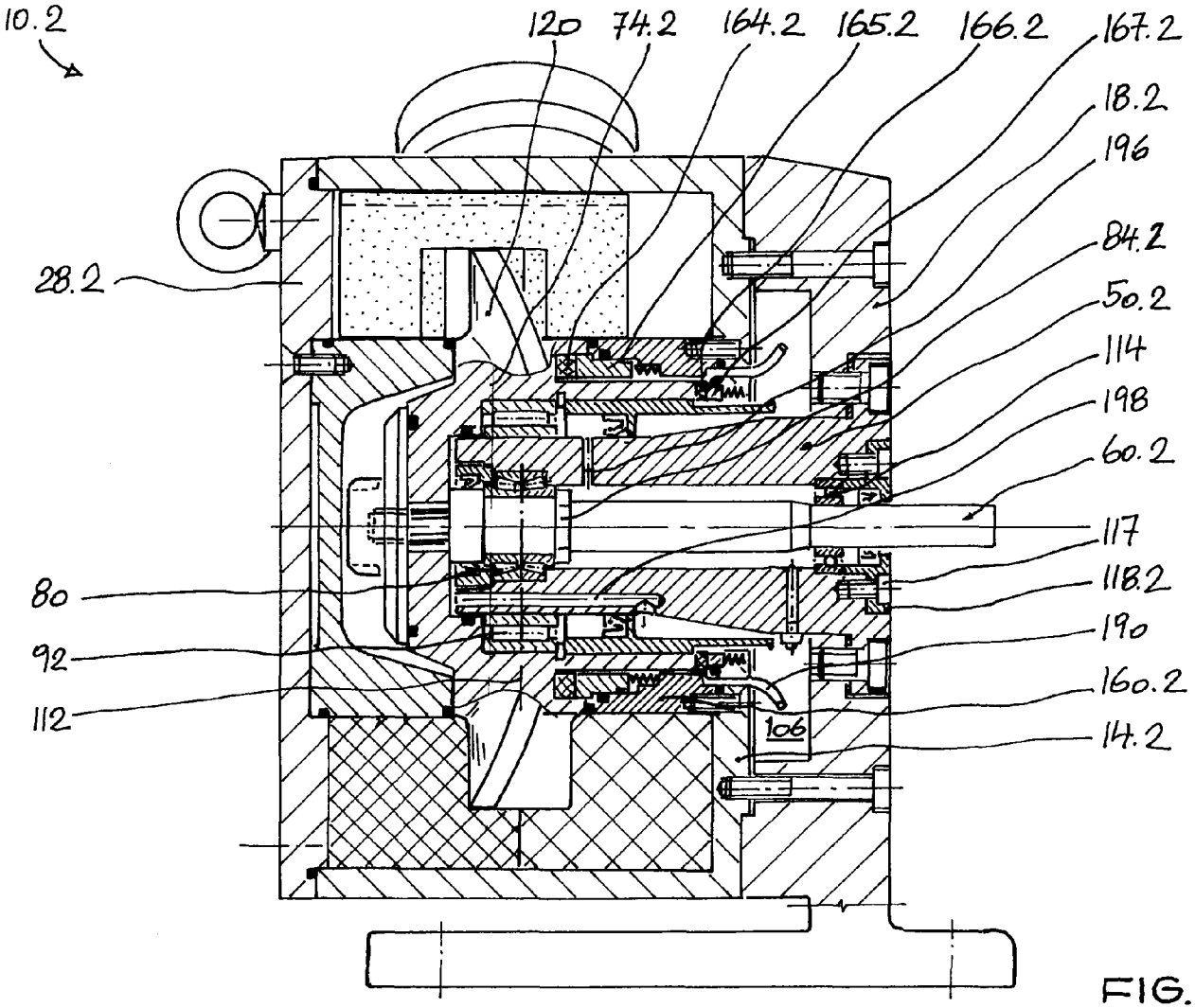
FIG. 2 shows a vertical longitudinal section through a second embodiment of a pump according to the invention.

The pump 10.2 illustrated in FIG. 2 is constructed, in principle, in the same way as the pump 10 described above. Its tapered roller bearing 80 and radial needle bearing 92 also lie in the same axial cross-sectional plane 112 which lies within the clear space region occupied in the axial direction by the rotor collar 120. The further bearing, which is present in the region of the holding flange 18.2 and, in the present example, likewise constitutes for the drive shaft 60.2 an auxiliary bearing designed as a ball bearing 114, is in this case, instead of the screwing ring 118 of the pump 10, a holding ring 118.2 which holds the shaft sealing 116 axially and which is held, firmly screwed to the shaft carrier 50.2, by means of screws 117.

As further differences from the pump 10, in the pump 10.2, its cover 28.2 is of planar design on the outside and its rear wall 14.2 is designed without the cross-sectional reinforcement present in the rear wall 14 in the lower region.

The holding ring 160.2, which corresponds to the holding ring 160, possesses a somewhat different cross-sectional shape from the holding ring 160 on account of the spatial conditions which are different from those of the pump 10. The function of said holding ring is the same as with the holding ring 160; it bears sealingly, via two sliding rings 165.2, 167.2 held on it so as to press away in the axial direction via spring rings, against sealing rings 164.2 or 166.2 held, integrally formed, in the rotor hub 74.2.

The tapered roller bearing 80 is held on its radial inside, so as to be supported by a screwing ring 84.2, instead of the bearing inner ring 84 present in the pump 10.

The interspace 106 is connected to the individual bearings by the leakage outflows 190 and transverse and longitudinal bores 196, 198, so that, on the one hand, bearings can be provided with oil lubrication and, on the other hand, in the event of leakages, corresponding media can flow into the interspace 106 and from there out from the pump 10 or 10.2 through orifices, not illustrated in the drawing, which are present in the holding flange 18 or 18.2.

Figure 3:
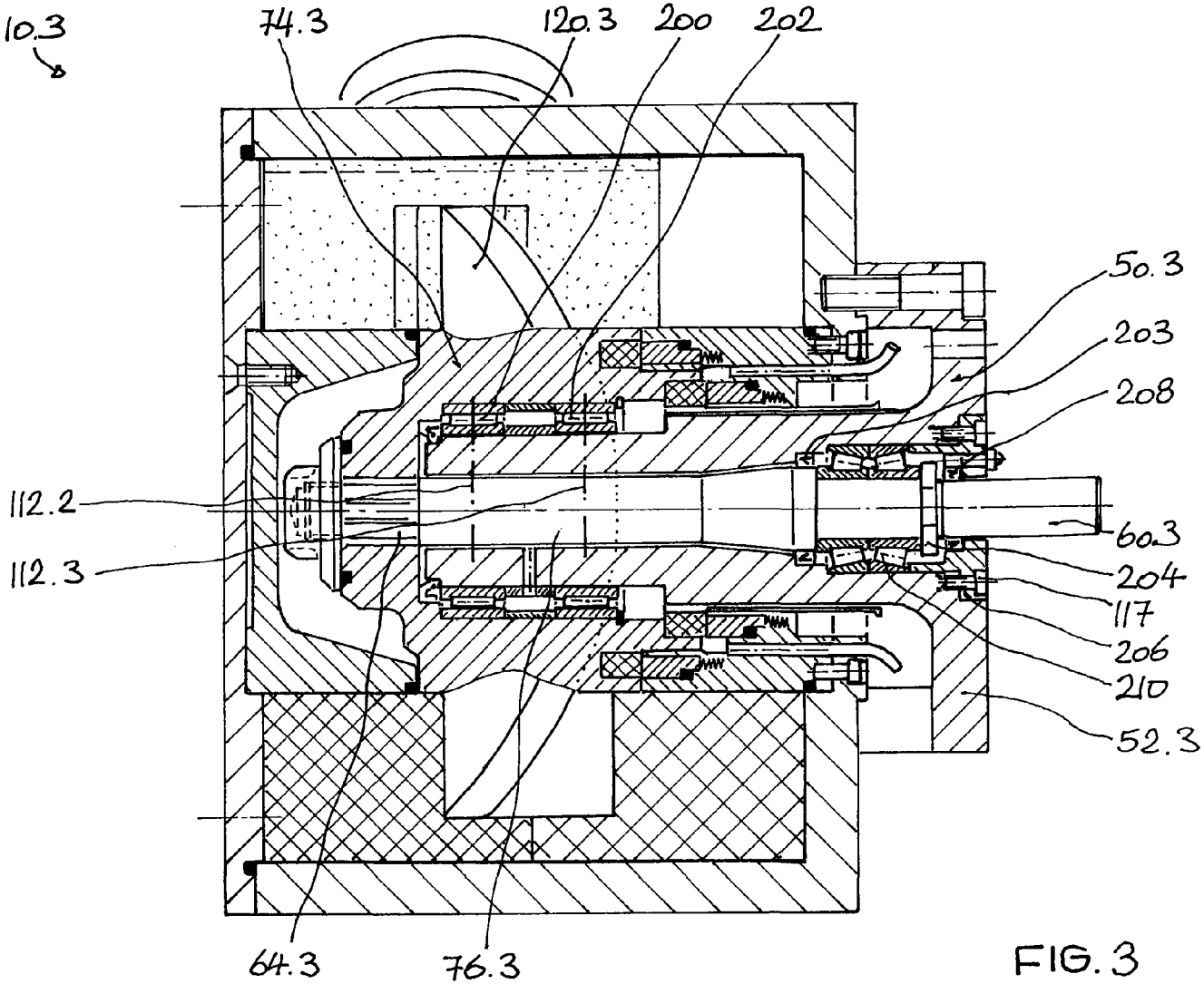
FIG. 3 shows a vertical longitudinal section through a third embodiment of a pump according to the invention.

In the pump 10.3 illustrated in FIG. 3, which is likewise designed basically in the same way as the pumps 10 and 10.2 in functional terms, two radial needle bearings 200, 202 are present in the axial projecting end region 76.3 of the drive shaft 60.3, specifically on the outside of the shaft carrier 50.3. The central cross-sectional planes 112.2, 112.3, with regard to the respective bearing 200, 202, again lie within the clear space region occupied in the axial direction by the rotor collar 120.3. In this design, the rotor hub 74.3 is designed to be sufficiently flexion-resistant so that the loads acting on the rotor hub 74.3 and consequently, via the projecting end region 64.3, on the drive shaft 60.3 during the operation of the pump 10.3 can be introduced into the shaft carrier 50.3. The drive shaft 60.3 is mounted, as it were suspended, on the shaft carrier 50.3 via the flexion-resistant rotor 74.3. In this design, which should preferably be used particularly in the case of high-power pumps operating at high pressures, construction height would be gained by dispensing with the tapered roller bearing 80 (FIGS. 1 and 2) present between the shaft carrier and the drive shaft. This construction height can be utilized by designing the shaft carrier and the drive shaft with correspondingly greater dimensioning in the case of a higher-power pump.

To absorb axial forces acting on the drive shaft 60, the bearing present in the region of the flange 52.3 of the shaft carrier 50.3 is designed as a tapered roller bearing 210. This tapered roller bearing is sealed off, on its axial side pointing toward the rotor, by a shaft sealing ring 203 held axially in a radial setback. On its opposite axial side, the tapered roller bearing 210 is held immovably on the drive shaft 60.3 by means of a screwing ring 204. On the outside of the screwing ring 204, a holding ring 206 is held, firmly screwed to the flange 52.3 of the shaft carrier 50.3, by means of screws 117 from outside. On the inside, in an annular reentry present there, the holding ring 206 has seated in it a shaft sealing ring 208 which, together with the shaft sealing ring 203, seals off the tapered roller bearing 210 on both sides in the axial direction.

The flange 52.3 of the shaft carrier 50.3 could be fastened by screwing to a bearing block or to the holding flange of a bearing block 20. It is also possible, however, to use the flange 52.3 of the shaft carrier 50.3 as a holding flange 18 and to fasten it, for example releasably, to a foot plate corresponding to the foot plate 38 or to another structural part.

Figure 4:
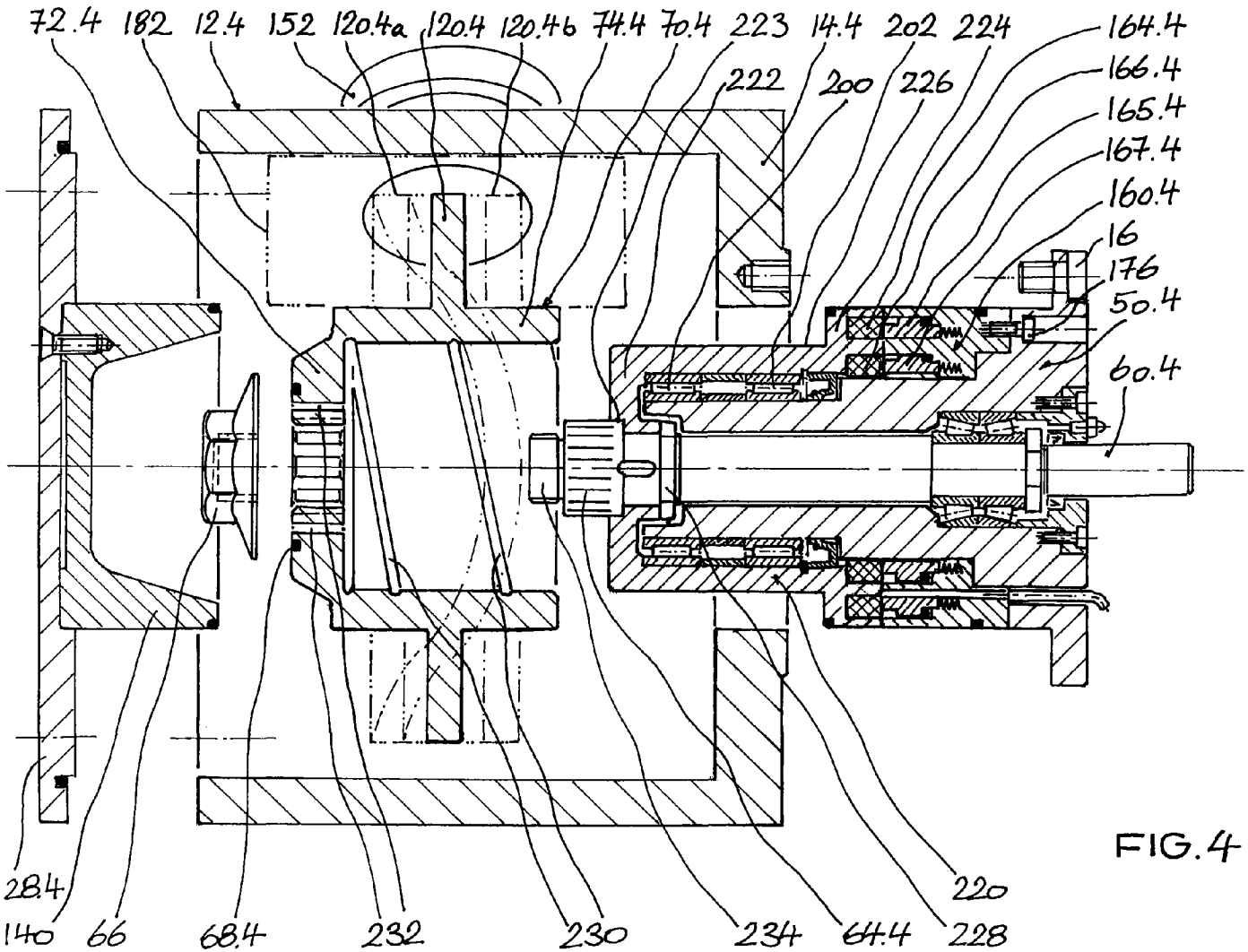
FIG. 4 shows a vertical longitudinal section through a fourth embodiment of a pump according to the invention, with individual components of the pump which are drawn axially apart from one another.

The pump 10.4 illustrated in FIG. 4 also functions basically in the same way as the pumps 10, 10.2 and 10.3 mentioned above. Thus, the pump 10.4 possesses a pot-like casing 12.4 which can be closed on its side on the left in FIG. 4 by means of a cover 28.4, as already explained with regard to the pumps described above. In its rear wall 14.4 axially opposite the cover 28.4, there is, once again, a central orifice through which a shaft carrier 50.4 can be pushed, with the drive shaft 60.4 mounted on it and with the holding ring 160.4 fastened to it by means of screws 176, into the interior of the casing 12.4 from outside, so as to project freely into the latter, and can be screwed firmly to the rear wall 14.4 by means of screws 16.

In the pump 10.4, the radial needle bearings 200 and 202 described with regard to the above pumps are not present between the shaft carrier 50.4 and the rotor 70.4, as is the case, for example, in the pump 10.3, but, instead, these two radial needle bearings 200, 202 are covered with a bush 220.

This bush 220 possesses a central orifice on its bottom region 222 which is on the left in FIG. 4, so that, with regard to FIG. 4, it can be pushed from the right onto the drive shaft 60.4 into its position illustrated in FIG. 4. After the sleeve 220 has been pushed on, the latter is held by means of a nut 228 screwed on the drive shaft 60.4. The shaft carrier 50.4 is then pushed with the radial needle bearings 200, 202 onto the drive shaft 60.4 from the same direction. In the mounted state, the bottom region 222 of the sleeve 220 and consequently the sleeve 220 lie firmly, fixed in position, between the projecting end 64.4 of the drive shaft 60.4 and the nut 228 by means of an annular setback 223.

That end of the bush 220 which is on the right in FIG. 4 has a flange 224, in which two sliding rings 164.4, 166.4 are fitted, radially one above the other. These two sliding rings 164.4, 166.4 bear against two sliding rings 165.4 and 167.4 which are present, likewise embedded in the holding ring 160.4. These sliding rings correspond to the corresponding sliding rings present between the holding ring and the rotor in the above pumps. In the pump 10.4, these sliding rings are not present between the rotor 70.4 and the holding ring 160.4, but, instead, between the bush 220 present in the pump 10.4 and the holding ring 160.4 in a comparable way.

The circle-cylindrical inside of the rotor hub 74.4 of the rotor 70.4 bears with virtually no play against the circle-cylindrical outer face 226 of the sleeve 220 when the rotor 70.4 is in the state in which it is pushed onto the bush 220. The play present between the rotor 70.4 and the bush 220 is required merely so that the rotor 70.4 can be pushed onto the bush 220 or drawn off from the latter again.

In order to allow or facilitate this mounting and demounting of the rotor 70.4, ventilation ducts are present in the rotor 70.4. In the design variant illustrated in FIG. 4, there are both an air groove 230 running around helically on the inside of the rotor hub 74.4 and air bores 232 which pass axially through the end wall 72.4 of the rotor hub 74.4. Only one embodiment of these two ventilation ducts (the air groove 230 and the air bores 232) is to be provided.

An O-ring 68.4 is mounted, countersunk, in the end wall 72.4 of the rotor hub 74.4, in such a way that it frames the air bores 232 circumferentially radially from outside. The closing nut 66, screwed onto the head 234 of the drive shaft 60.4 in the assembled state, bears sealingly against the O-ring 68.4. The air bores 232 are thereby closed sealingly by the closing nut 66 in the assembled state of the pump 10.4.

As already described with regard to the above pumps, the shaft carrier 50.4 can be screwed to the rear wall 14.4 by means of screws 16. The structural part capable of being drawn off from the rear wall 14.4 as a result of the loosening of the screws 16 is illustrated, partially drawn out to the right in the axial direction, in FIG. 4.

Of the rotor 70.4 present in the interior of the pump 10.4, its rotor collar 120.4 with an axially middle region is illustrated. Furthermore, two axial end positions of the collar 120.4 bearing reference symbol 120.4*a* and 120.4*b* are illustrated by dashes and dots. The rotor collar 120.4 always bears sealingly in an orifice of the sealing slide 182 on the right and left in the axial direction, as likewise already described above.

In the pump 10.4, too, a front bush 140 is present between the end wall 72.4 and the cover 28.4. The radial outside of the front bush 140 constitutes, together with the rotor hub 74.4 and the outer face 226 of the bush 220 and also the outer face of the holding ring 160.4, the bottom of the suction-intake space or of the outlet space, via which the pumping duct is connected in each case on the one hand, to the inlet 152 and, on the other hand, to the outlet, not illustrated in FIG. 4, of the pumps 10.4.

The invention claimed is:

1. A pump, with a rotor, which is present fixedly in terms of rotation on a drive shaft connectable to a motor drive and which possesses a radially projecting rotor collar running around in a wavy manner, and a rotor hub, surrounding a projecting end region of the drive shaft, with delimiting faces delimiting the rotor collar on both sides in the axial direction and leaving between them a pumping duct, with an inlet and an outlet for the pumping duct, with an axially adjustable sealing slide bearing sealingly against the rotor collar on both sides in the axial direction and subdividing the pumping duct between the inlet and the outlet, characterized in that a first bearing for the drive shaft, for the supporting the mounting of the drive shaft in the radial direction and for absorbing radial and axial forces, is present at the projecting end region of the drive shaft within a clear space region in the axial direction of the shaft occupied by the rotor collar;

this first bearing has at least one bearing which is present within the clear space region occupied in the axial direction by the rotor collar, a bush is present on the inside of a the rotor hub of the rotor in such a way that the bush sealingly covers each of the bearings which are freely accessible after the removal of the rotor from the drive shaft, there is in the rotor hub at least one ventilation duct through which air can flow when the rotor is pushed onto the bush or when the rotor is drawn off from the bush, and a ventilation groove is present and is integrally formed in the rotor hub on the inside as a ventilation duct.

2. The pump as claimed in claim 1, characterized in that a sleeve-shaped shaft carrier carrying the drive shaft is projects from the pump outer wall adjacent to the motor drive toward the clear space region, this first bearing point for the drive shaft is present in the projecting end region of the shaft carrier.

3. The pump as claimed in claim 2, characterized in that the rotor is fastened fixedly in terms of rotation in the projecting end of the drive shaft, the rotor is mounted rotatably in the manner of an end cap on the shaft carrier.

4. The pump as claimed in claim 2, characterized in that the first bearing point for the drive shaft of the rotor is present on the inside of the shaft carrier and a bearing point for the rotor, for the supporting mounting of the rotor in the axial direction, is present on the opposite outside of the shaft carrier.

5. The pump as claimed in claim 4, characterized in that the first bearing point, present in the projecting end region of the shaft carrier, for the drive shaft and the bearing point for the rotor are present in the same axial cross-sectional plane.

6. The pump as claimed in claim 3, characterized in that the first bearing point for the drive shaft is present on the outside of the shaft carrier, this bearing point is at the same time a bearing point for the rotor, for the supporting mounting of the rotor in the axial direction.

7. The pump as claimed in claim 2, characterized in that the first bearing point consists of a plurality of bearings.

8. The pump as claimed in claim 2, characterized in that a second bearing point for the drive shaft is present in the region of the pump outer wall adjacent to the motor drive, this second bearing point is designed at least for the supporting mounting of the drive shaft in the radial direction.

9. The pump as claimed in claim 2, characterized in that it possesses a pump casing and a bearing block carrying the latter, the pump casing is fastened releasably with its axial rear wall to a holding flange of the bearing block.

10. The pump as claimed in claim 9, characterized in that the drive shaft penetrates through the holding flange and terminates in the pump casing.

11. The pump as claimed in claim 10, characterized in that a bearing point for the drive shaft is present in the holding flange.

12. The pump as claimed in claim 9, characterized in that the pump casing can be fastened, such as, in particular, firmly screwed, to the holding flange in various rotary positions.

13. The pump as claimed in claim 3, characterized in that the shaft carrier intrinsically carrying the drive shaft for the rotor and projecting into the pump casing can be fastened to the holding flange of the bearing block.

14. The pump as claimed in claim 9, characterized in that the pump casing can be screwed, such as, in particular, can be screwed in various rotary positions, to a flange of the shaft carrier.

15. The pump as claimed in claim 1, characterized in that the bush is mounted fixedly in terms of rotation on the drive shaft.

16. The pump as claimed in claim 1, characterized in that at least one ventilation bore in an the end wall region of the rotor hub is present as a ventilation duct.

17. The pump as claimed in claim 1, characterized in that the ventilation groove is present helically.

18. The pump as claimed in claim 1, characterized in that a holding ring is sealed off with respect to the bush in the axial direction.

19. The pump as claimed in claim 18, characterized in that there is in the bush at least one sliding ring which, pressing in the axial direction, can be brought to bear in each case against at least one sliding ring present in the holding ring.

* * * * *